US011788727B2

(12) United States Patent
Chabaille et al.

(10) Patent No.: US 11,788,727 B2
(45) Date of Patent: Oct. 17, 2023

(54) INJECTOR NOSE FOR TURBOMACHINE COMPRISING A PRIMARY FUEL CIRCUIT ARRANGED AROUND A SECONDARY FUEL CIRCUIT

(71) Applicant: SAFRAN AIRCRAFT ENGINES, Paris (FR)

(72) Inventors: Christophe Chabaille, Moissy-Cramayel (FR); Clément Yves Emile Bernard, Moissy-Cramayel (FR); Sébastien Christophe Loval, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 158 days.

(21) Appl. No.: 17/417,505

(22) PCT Filed: Dec. 26, 2019

(86) PCT No.: PCT/FR2019/053302
§ 371 (c)(1),
(2) Date: Jun. 23, 2021

(87) PCT Pub. No.: WO2020/136359
PCT Pub. Date: Jul. 2, 2020

(65) Prior Publication Data

US 2022/0113024 A1 Apr. 14, 2022

(30) Foreign Application Priority Data

Dec. 27, 2018 (FR) ..... 1874261

(51) Int. Cl.
*F23R 3/28* (2006.01)

(52) U.S. Cl.
CPC ..... *F23R 3/286* (2013.01); *F23R 3/283* (2013.01)

(58) Field of Classification Search
CPC .... F23R 3/14; F23R 3/28; F23R 3/283; F23R 3/286; F23R 3/343
See application file for complete search history.

(56) References Cited

U.S. PATENT DOCUMENTS 5,570,580 A 11/1996 Mains
2007/0068164 A1 3/2007 Hernandez et al.
(Continued)

FOREIGN PATENT DOCUMENTS

EP 1770333 A1 4/2007
FR 2896303 A1 7/2007
FR 3011318 A1 4/2015

OTHER PUBLICATIONS

Search Report issued in French Patent Application No. 1874261 dated Oct. 3, 2019.

(Continued)

*Primary Examiner* — William H Rodriguez
(74) *Attorney, Agent, or Firm* — Pearne & Gordon LLP

(57) ABSTRACT

An injector nose for a turbomachine includes a primary fuel circuit ending in a fuel-ejection nozzle, and a secondary fuel circuit including an annular-shaped terminal fuel-ejection part arranged around the fuel-ejection nozzle. An upstream part of the primary fuel circuit includes an annular channel, which extends around the secondary fuel circuit and is defined by an external wall of the injector nose. The injector nose includes air intake channels extending through the annular channel and having inlets opening into the external wall and outlets opening into an annular air injection channel arranged radially to the inside in relation to the terminal fuel-ejection part, around the fuel-ejection nozzle, and cooperating with the terminal fuel-ejection part in order to form an aerodynamic secondary injector.

11 Claims, 5 Drawing Sheets

(56) References Cited

U.S. PATENT DOCUMENTS

| | | | | |
|---|---|---|---|---|
| 2016/0237911 | A1 | 8/2016 | Chabaille et al. | |
| 2017/0184307 | A1 | 6/2017 | Patel et al. | |
| 2017/0298829 | A1* | 10/2017 | Ozem | F02C 7/222 |
| 2019/0292988 | A1 | 9/2019 | Chabaille | |
| 2020/0208841 | A1 | 7/2020 | Chabaille et al. | |

OTHER PUBLICATIONS

International Search Report for issued in Application No. PCT/FR2019/053302 dated Apr. 29, 2020.
Written Opinion for PCT/FR2019/053302 dated Apr. 29, 2020.

* cited by examiner

INJECTOR NOSE FOR TURBOMACHINE COMPRISING A PRIMARY FUEL CIRCUIT ARRANGED AROUND A SECONDARY FUEL CIRCUIT

This is the National Stage of PCT international application PCT/FR2019/053302, filed on Dec. 26, 2019 entitled "INJECTOR NOZZLE FOR TURBOMACHINE COMPRISING A PRIMARY FUEL CIRCUIT ARRANGED AROUND A SECONDARY FUEL CIRCUIT", which claims the priority of French Patent Application No. 1874261 filed Dec. 27, 2018, both of which are incorporated herein by reference in their entirety.

TECHNICAL FIELD

The invention relates to the general field of fuel injectors that equip the combustion chamber of a turbomachine, in particular a turbomachine of the type intended for propelling aircraft.

PRIOR ART

The combustion chambers of turbomachines are in general equipped with fuel injectors associated with premixing systems, normally referred to as "injection systems", in general comprising one or more swirlers (axial and/or radial), which use the air coming from a compressor arranged upstream of the combustion chamber to atomise the fuel in the combustion chamber.

Two categories of injector are normally used: aerodynamic injectors, which mainly use the pressure and speed of the air output from the compressor to rotate the fuel emerging from the nose of the injector, and aeromechanical injectors that mainly use the pressure of the fuel inside the nose of the injector to rotate and atomise the fuel.

Moreover, the noses of dual-circuit fuel injectors comprise a primary fuel circuit, also referred to as the pilot circuit, comprising a primary fuel swirler supplying a primary injector (also referred to as a pilot injector) arranged on an axis of the injector nose, and a secondary fuel circuit, also referred to as the main circuit, comprising a secondary fuel swirler supplying a secondary injector (also referred to as the main injector) arranged around the primary injector. These may be aeromechanical injectors or a combination of an aeromechanical primary injector and an aerodynamic secondary injector.

The use of this type of injector has developed to satisfy standards that are increasingly demanding in terms of emission of pollutants.

The primary circuit is in general intended to supply the combustion chamber with fuel in all operating speeds, in particular during the ignition and coiling phases, that is to say of propagation of flame to the adjacent sectors.

The secondary circuit is intended to supply the engine at speeds ranging from cruising flight up to takeoff.

The injector noses are in general subjected to the high temperatures of the combustion chamber, which causes a risk of coking of the stagnant fuel in the secondary fuel circuit at speeds of the turbomachine at which the secondary injector is not in operation.

One known solution consists of arranging a cooling-air circuit at the periphery of the injector nose in order to provide thermal protection and thermal cooling of the whole of the injector nose.

However, this solution has in particular the drawback of increasing the size of the injector nose.

Another solution, known from the documents US 2016/0237911 A1 and US 2007/0068164 A1, consists in arranging an upstream part of the primary fuel circuit around an upstream part of the secondary fuel circuit.

The injector noses presented in these documents do not however enable air to be injected between the primary and secondary injectors.

DISCLOSURE OF THE INVENTION

The aim of the invention is in particular to remedy this problem while limiting the radial size of the injector nose.

For this purpose the invention proposes an injector nose for a turbomachine, comprising a primary fuel circuit terminating in a fuel-ejection nozzle emerging on an injection axis, and a secondary fuel circuit comprising an annular-shaped terminal fuel-injection part arranged around the fuel-ejection nozzle, and wherein an upstream part of the primary fuel circuit, housed in the injector nose, comprises an annular channel extending around the secondary fuel circuit and delimited by an external wall of the injector nose.

According to the invention, the injector nose further comprises air inlet channels extending through the annular channel of the primary fuel circuit and having respective inlets opening in the external wall and respective outlets emerging in an annular air-injection channel arranged radially towards the inside with respect to the terminal fuel-ejection part, around the fuel-ejection nozzle, and cooperating with the terminal fuel-ejection part to form an aerodynamic secondary injector.

Because fuel flows in the upstream part of the primary circuit whatever the operating speed of the turbomachine, the upstream part of the primary circuit thus makes it possible to ensure thermal protection and cooling of the injector nose, in particular of the secondary circuit around which the upstream part of the primary circuit extends.

In addition, integrating air inlet channels, which extend through the annular channel of the primary fuel circuit and have respective inlets opening in the external wall and respective outlets emerging in an annular air-injection channel arranged radially towards the inside with respect to the terminal fuel-ejection part, allows air to be injected intended to mix with the fuel of secondary fuel circuit in the injector nose, in a particularly compact manner, especially in the radial direction.

Preferably, the primary fuel circuit comprises primary connection channels connecting the upstream part of the primary fuel circuit to the fuel-ejection nozzle and comprising respective inlets and respective outlets, the respective inlets being arranged radially towards the outside with respect to the respective outlets.

The secondary fuel circuit preferably comprises a tubular channel centred on the injection axis and which divides, at a downstream end, into a plurality of secondary connection channels each formed so as to move away from the injection axis in a direction going from upstream to downstream, and each arranged between two consecutive primary connection channels.

The annular channel of the upstream part of the primary fuel circuit is preferably arranged around the tubular channel and around the secondary connection channels of the secondary fuel circuit.

The secondary fuel circuit preferably comprises a secondary fuel swirler formed by swirler channels having respective upstream ends, and having respective downstream ends emerging in the terminal fuel-ejection part.

The secondary fuel circuit preferably comprises an annular-shaped secondary tranquilisation chamber to which the respective upstream ends of the swirler channels forming the secondary fuel swirler are connected.

The annular channel of the upstream part is preferably extended towards the downstream end beyond the primary connection channels so as to form a terminal annular chamber surrounding the secondary fuel swirler.

Each swirler channel preferably has a cross section of flow that decreases in a direction going from the upstream end towards the downstream end of the swirler channel.

The secondary fuel circuit preferably comprises an annular-shaped secondary tranquilisation chamber to which the respective upstream ends of the swirler channels forming the secondary fuel swirler are connected.

The invention also relates to an injection module for a turbomachine, comprising an injection system, and an injector nose of the type described above, wherein the injection system comprises, from upstream to downstream, a bushing into which the injector nose is mounted, at least one air inlet swirler emerging downstream of the injector nose, and a bowl.

The invention also relates to a turbomachine comprising at least one injector nose of the type described above, or at least one injection module of the type described above.

BRIEF DESCRIPTION OF THE DRAWINGS

The invention will be better understood, and other details, advantages and features thereof will emerge from the reading of the following description made by way of non-limitative example and with reference to the accompanying drawings, wherein.

DETAILED DESCRIPTION OF PREFERRED EMBODIMENTS

Figure 1:
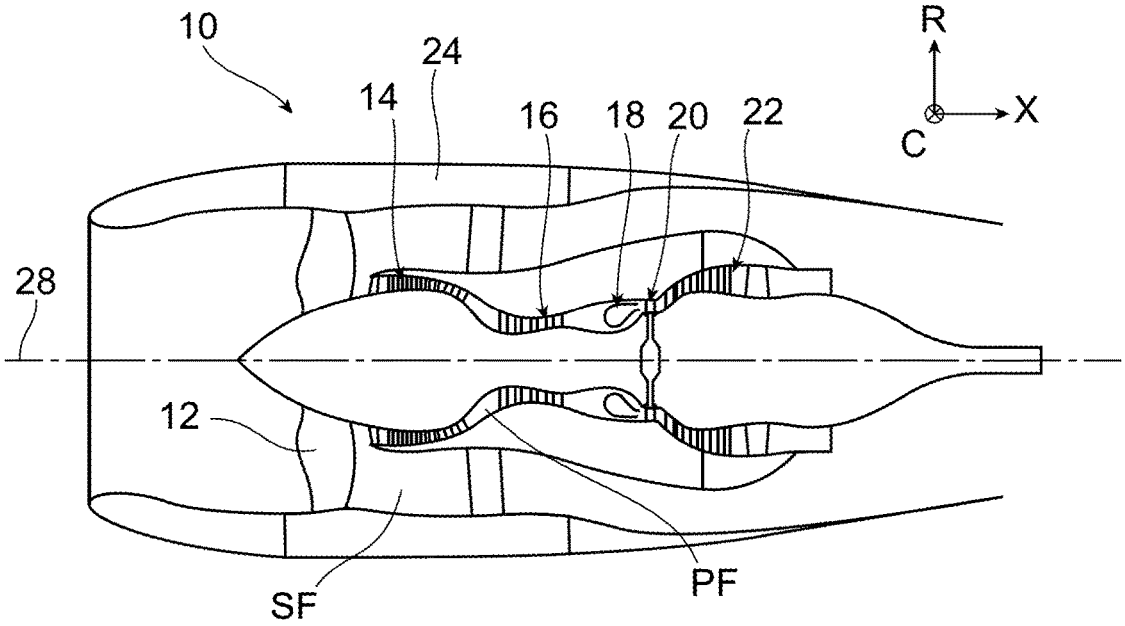
FIG. 1 is a schematic view in axial section of a turbomachine according to a preferred embodiment of the invention.

FIG. 1 illustrates a turbomachine 10 for an aircraft of a known type, comprising in general terms a fan 12 intended for aspirating an air flow dividing downstream of the fan into a primary flow flowing in a primary flow channel, hereinafter referred to as the primary flow PF, in a core of the turbomachine, and a secondary flow passing round this core in a secondary flow channel, hereinafter referred to as the secondary flow SF.

The turbomachine is for example of the bypass and twin spool type. The core of the turbomachine thus comprises, in general terms, a low-pressure compressor 14, a high-pressure compressor 16, a combustion chamber 18, a high-pressure turbine 20 and a low-pressure turbine 22.

The respective rotors of the high-pressure compressor and of the high-pressure turbine are connected by a shaft referred to as the "high-pressure shaft", while the respective rotors of the low-pressure compressor and of the low-pressure turbine are connected by a shaft referred to as a "low-pressure shaft", in a well-known manner.

The turbomachine is streamlined by a nacelle 24 surrounding the secondary flow SF. Moreover, the rotors of the turbomachine are mounted so as to rotate about a longitudinal axis 28 of the turbomachine.

Throughout this description, the longitudinal direction X is the direction of the longitudinal axis 28.

In addition, in a first part of this description, the radial direction R is at every point a direction orthogonal to the longitudinal axis 28 and passing through the latter, and the circumferential or tangential direction C is at every point a direction orthogonal to the radial direction R and to the longitudinal axis 28. The terms "internal" and "external" refer respectively to a relative proximity to, and a relative distancing from, an element with respect to the longitudinal axis 28. Moreover, the directions "upstream" and "downstream" are defined by reference to the general direction of flow of the gases in the primary flow PF and secondary flow SF of the turbomachine.

Figure 2:
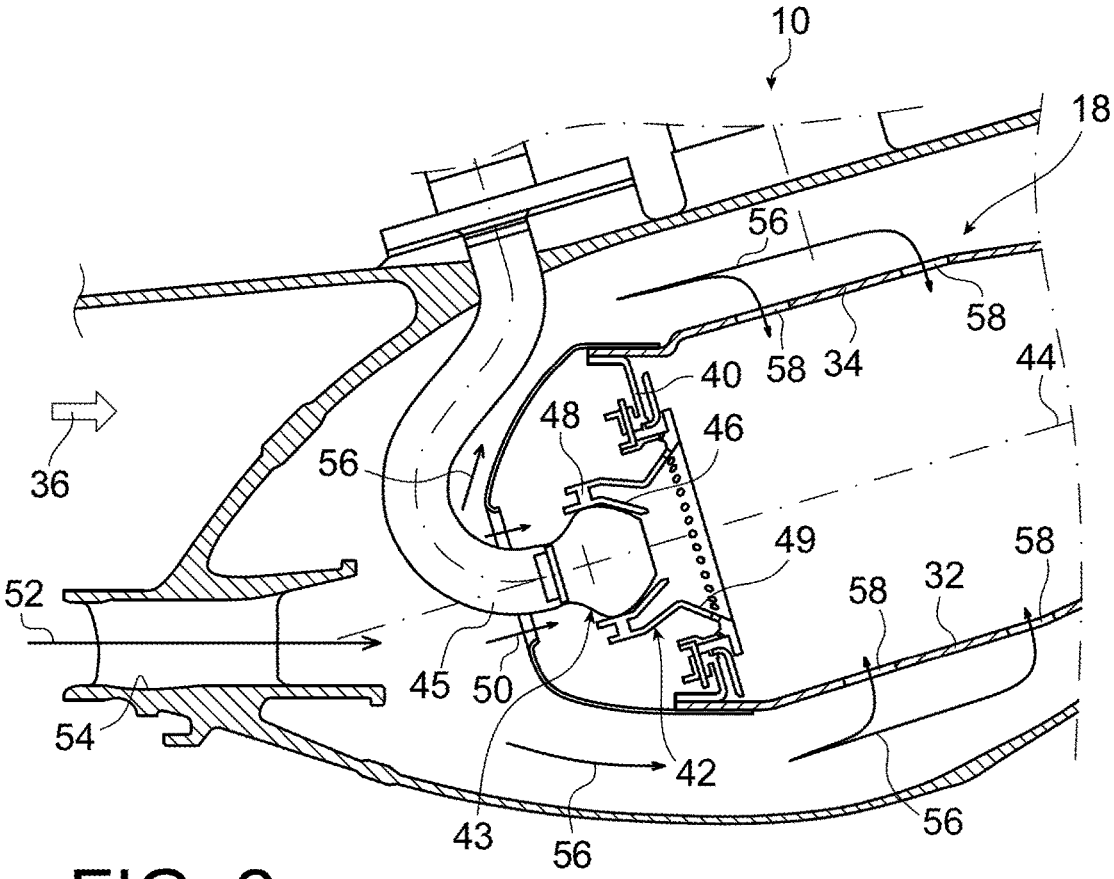
FIG. 2 a schematic view in axial section of a combustion chamber of the turbomachine of FIG. 1.

FIG. 2 shows the combustion chamber 18 of the turbomachine 10 of FIG. 1 and the immediate environment thereof.

Ina conventional manner, this combustion chamber, which is for example of the annular type, comprises two coaxial annular walls, respectively radially internal 32 and radially external 34, which extend from upstream to downstream, in the direction of flow 36 of the primary flow of gas in the turbomachine, around the longitudinal axis 28 of the turbomachine. These internal 32 and external 34 annular walls are connected together at the upstream end thereof by an annular chamber-bottom wall 40 that extends substantially radially around the longitudinal axis 28. This annular chamber-bottom wall 40 is equipped with injection systems 42 distributed around the longitudinal axis 28, one of which is visible in FIG. 2, each receiving an injector nose 43 mounted at the end of an injector pipe 45, to allow the injection of a premixture of air and fuel centred on a respective injection axis 44.

More precisely, each injection system 42 comprises a bushing 46, normally referred to as a "sliding traverse", wherein the corresponding injector nose 43 is mounted with an ability to slide to allow differential thermal expansions in operation.

In the example illustrated, the bushing 46 delimits internally a single air-inlet swirler 48, for example of the axial type, formed in the injection system 42.

Each injection system 42 further comprises a divergent bowl 49 arranged at the outlet of the air inlet swirler 48 and emerging in the combustion chamber 18.

The assembly formed by an injection system 42 and the corresponding injector nose 43 constitutes an injection module, in the terminology of the present invention.

In operation, a part 50 of an air flow 52 issuing from a diffuser 54 and coming from the high-pressure compressor 16 supplies the injection systems 42, while another part 56 of the air flow 52 supplies air inlet orifices 58 formed in the walls 32 and 34 of the combustion chamber, in a well known manner.

In the remainder of the present description, with reference to FIGS. 3 to 9, the radial direction R' is at every point a direction orthogonal to the injection axis 44 and passing through the latter, and the circumferential or tangential direction C' is at every point a direction orthogonal to the radial direction R' and to the injection axis 44. The terms "internal" and "external" refer respectively to a relative proximity to, and a relative distancing from, an element with respect to the injection axis 44. Moreover, the directions "upstream" and "downstream" are defined with reference to the general direction of flow of the air and fuel in the injector nose 43. In addition, a transverse plane is defined as a plane orthogonal to the injection axis 44, while an axial plane is defined as a plane containing the injection axis 44.

FIGS. 3 to 9 illustrate in more detail an injector nose 43 according to a preferred embodiment of the invention.

The injector nose 43 comprises a body 60, preferably in a single piece, comprising a connector 61 (FIGS. 3 and 5) by means of which the injector nose 43 is intended to be connected to an injector pipe 45 as in FIG. 2.

Figure 3:
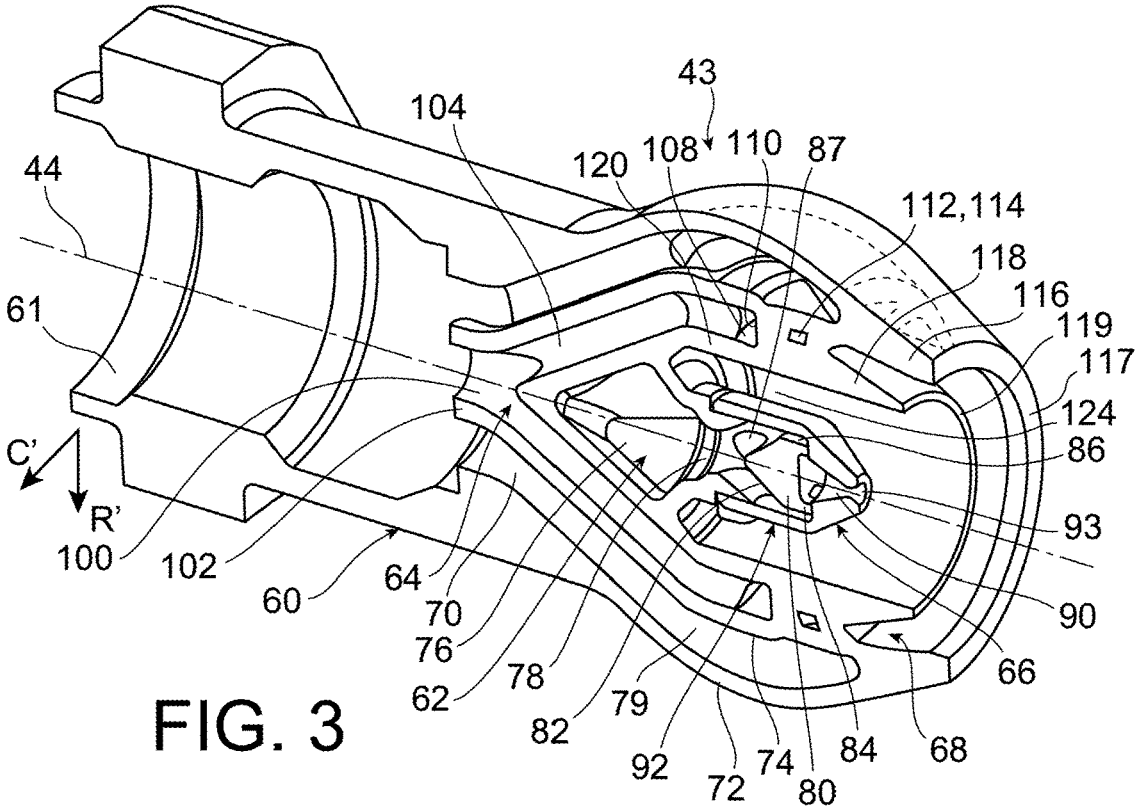
FIG. 3 is a schematic view in perspective and in axial section of an injector nose equipping the combustion chamber of FIG. 2.

In the body 60, two fuel circuits are provided, namely a primary circuit 62 and a secondary circuit 64 (FIG. 3).

The primary circuit 62 terminates in a central fuel-ejection nozzle 66 of the aeromechanical type, while the secondary circuit 64 has a terminal fuel-ejection part 68 of the aerodynamic type arranged around the fuel-ejection nozzle 66 (FIGS. 3-6), as will emerge more clearly hereinafter.

Figure 8:
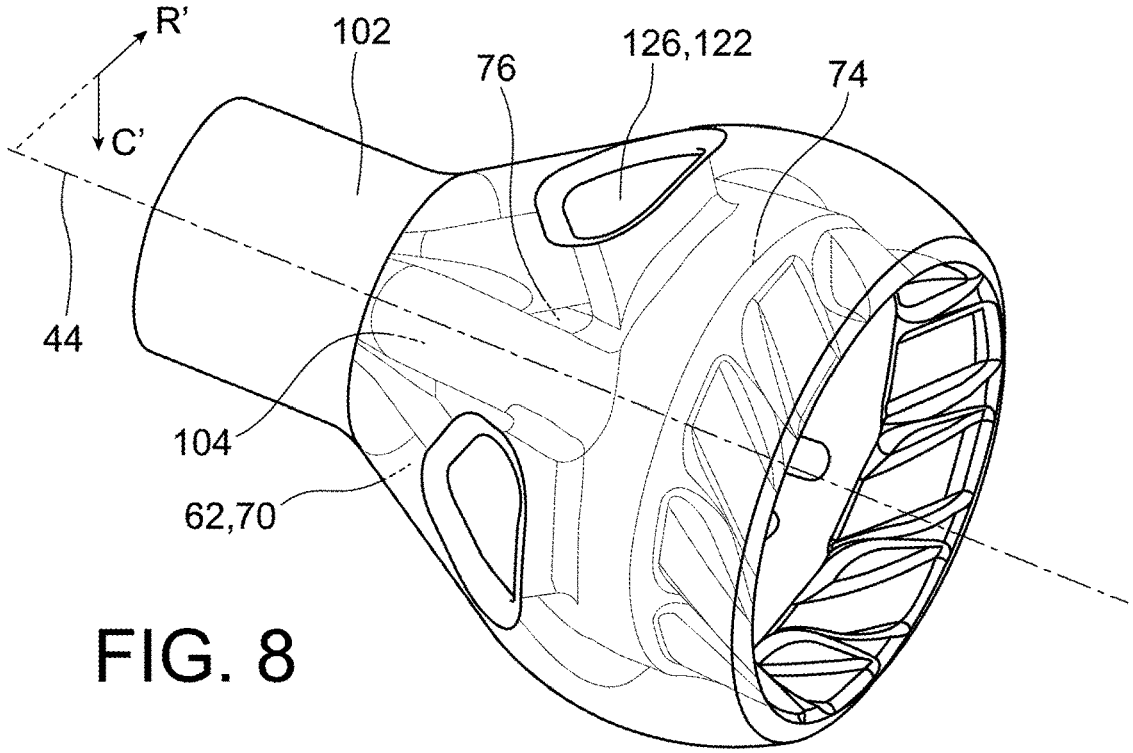
FIG. 8 is a partial schematic view in perspective of the primary fuel circuit of the injector nose of FIG. 3.

The primary circuit 62 comprises an annular channel 70 defined between an external wall 72, annular in shape overall, of the body 60 (FIGS. 3-7), which delimits the latter externally, and a roughly annular and complex-shaped internal casing 74, shown isolated in FIG. 8.

The primary circuit 62 further comprises primary connection channels 76 (FIGS. 3, 4 and 8) that connect the annular channel 70 to an inlet chamber 78 (FIGS. 3 and 4) of the fuel-ejection nozzle 66. The primary connection channels 76 are for example four in number and are preferably regularly spaced apart around the injection axis 44.

The inlet chamber 78 is arranged in the injection axis 44, radially towards the inside with respect to the annular channel 70.

The primary connection channels 76 thus have respective inlets connected to the annular channel 70, and respective outlets connected to the inlet chamber 78. The respective inlets of the primary connection channels 76 are arranged radially towards the outside with respect to their respective outlets. In the example illustrated, the primary connection channels 76 extend in respective directions substantially orthogonal to the injection axis 44, for example substantially radial.

The annular channel 70 is extended downstream beyond the primary connection channel 76 so as to form a terminal annular chamber 79.

The fuel-ejection nozzle 66 comprises a core 80 that forms part of the body 60 and is centred on the injection axis 44 and arranged at a downstream end of the inlet chamber 78 (FIGS. 3 to 6). The core 80 has an upstream part 82 that is extended downstream and an annular surface 84 that internally delimits an annular-shaped primary tranquilisation chamber 86 in the fuel-ejection nozzle 66. Feed channels 87 inclined with respect to the injection axis 44 and with respect to the radial direction R' connect the inlet chamber 78 to the primary tranquilisation chamber 86. Orthoradial injection channels 88 (FIGS. 4 and 6), i.e. orthogonal to the injection axis 44 and non-secant therewith, connect a downstream end of the primary tranquilisation chamber 86 to a convergent vortex chamber 90 (FIG. 3). The orientation of the injection channels 88 favours the gyration of the fuel in the vortex chamber 90.

The primary circuit 62, and more particularly the fuel-ejection nozzle 66, comprises a terminal connection 92 (FIGS. 3 and 5) that is mounted on a downstream end of the body 60 and externally delimits the primary tranquilisation chamber 86 and the vortex chamber 90. This terminal connector 92 comprises a cylindrically-shaped upstream part of revolution externally delimiting the primary tranquilisation chamber 86, and a frustoconically-shaped downstream part externally delimiting the vortex chamber 90 and terminating in a fuel-ejection orifice 93 (FIG. 3) intended to diffuse, in spray form, the fuel coming from the vortex chamber 90.

Figure 9:
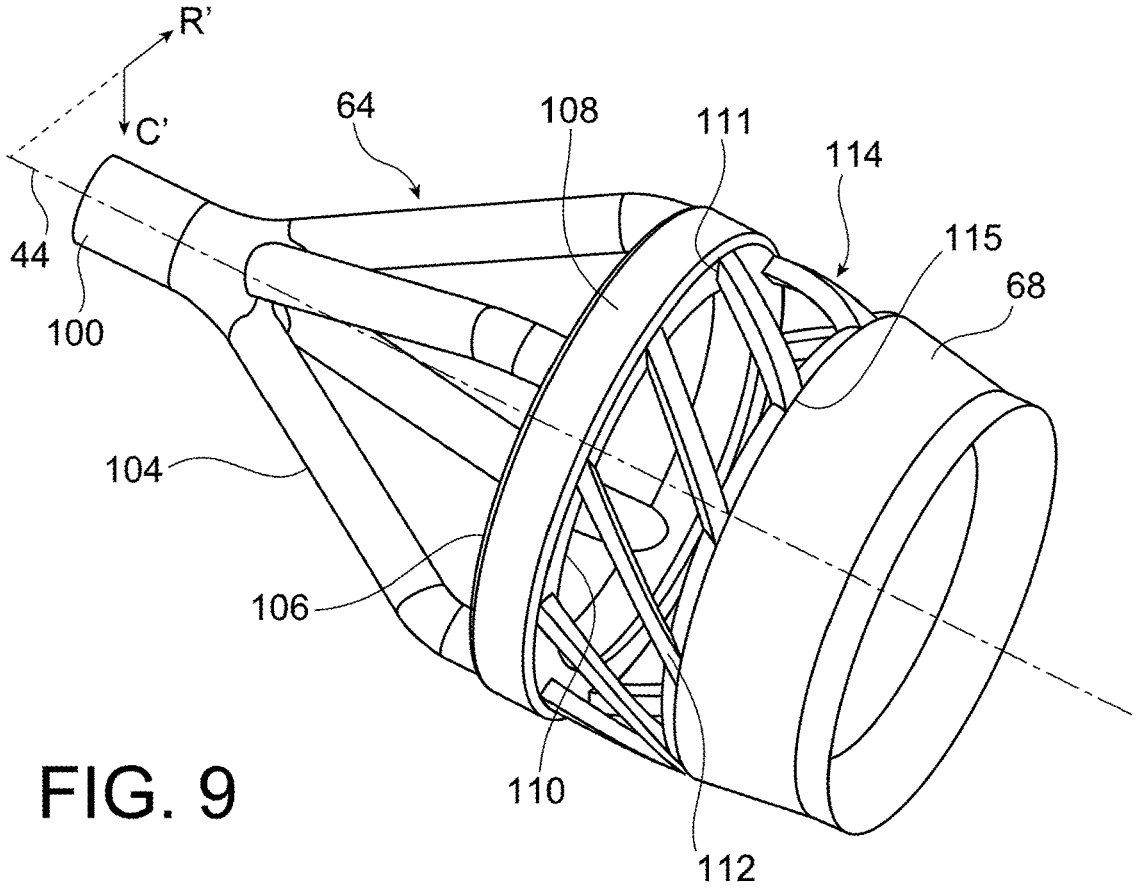
FIG. 9 is a partial schematic view in perspective of a secondary fuel circuit of the injector nose of FIG. 3.

The secondary circuit 64 will now be described with reference to FIGS. 3-6 and 9. FIG. 9 shows the internal volume of the secondary circuit 64, i.e. the space occupied by the fuel in operation. The walls delimiting the various parts of the secondary circuit 64 that will be described are visible as reliefs in the internal casing 74 of the primary circuit 62, visible in FIG. 8.

The secondary circuit 64 comprises a tubular channel 100 (only a terminal part of which is shown in the figures), centred on the injection axis 44, and delimited externally by a cylindrical wall 102 (only a terminal part of which is shown in the figures), which delimits internally an upstream part of the annular channel 70 of the primary circuit (and which therefore forms an upstream part of the aforementioned internal casing 74).

As is clearer in FIG. 9, which shows the secondary circuit 64 isolated from the rest of the injector nose, the tubular channel 100 divides, at the downstream end thereof, into four secondary connection channels 104 regularly distributed around the injection axis 44 and each formed to move away from the injection axis 44 in the direction going from upstream to downstream.

Each of the secondary connection channels 104 fits for example in a respective axial plane. The secondary connection channels 104 have respective downstream ends emerging on an upstream end surface 106 of an annular-shaped secondary tranquilisation chamber 108, centred on the injection axis 44. This secondary tranquilisation chamber 108 is delimited downstream by a downstream end surface 110 in which respective upstream ends 111 of swirler channels 112 forming a secondary fuel swirler 114 open out.

Figure 4:
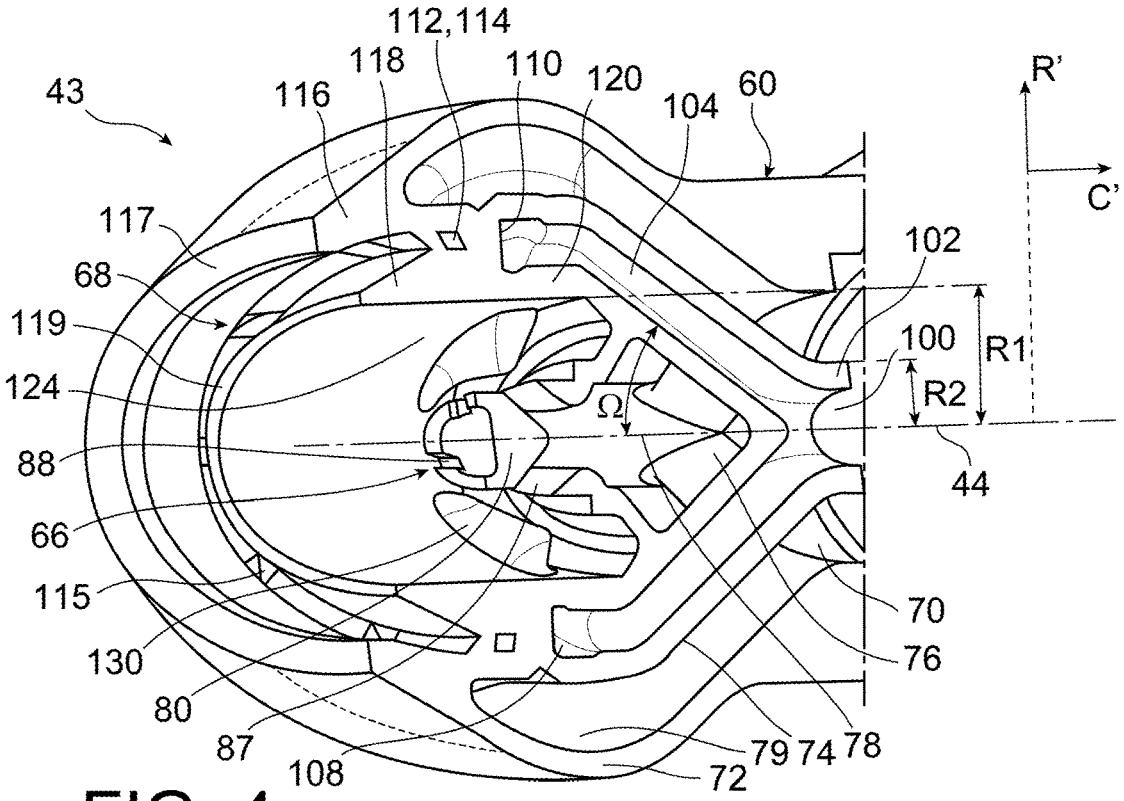
FIG. 4 is a schematic view in perspective and in axial section of the injector nose of FIG. 3 without a terminal connector of a primary fuel circuit, and seen at a different angle.
Figure 5:
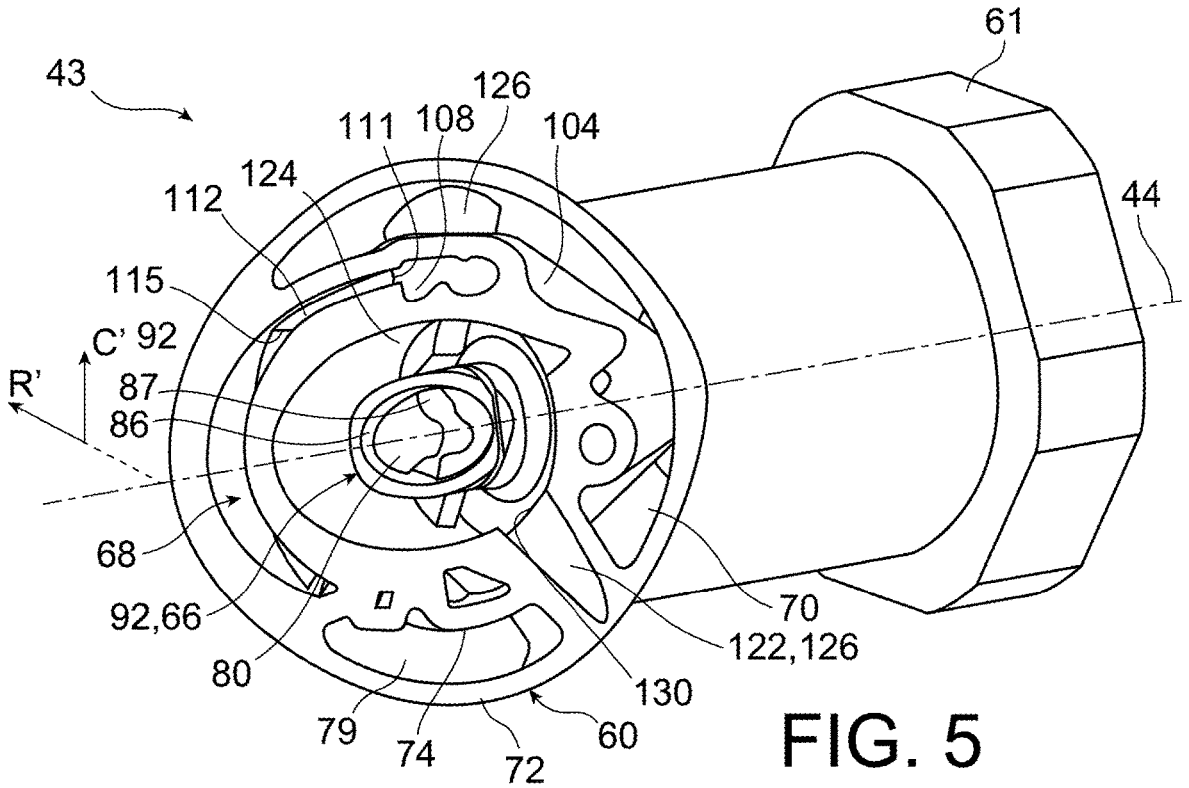
FIG. 5 is a schematic view in perspective and in oblique section of the injector nose of FIG. 3.
Figure 6:
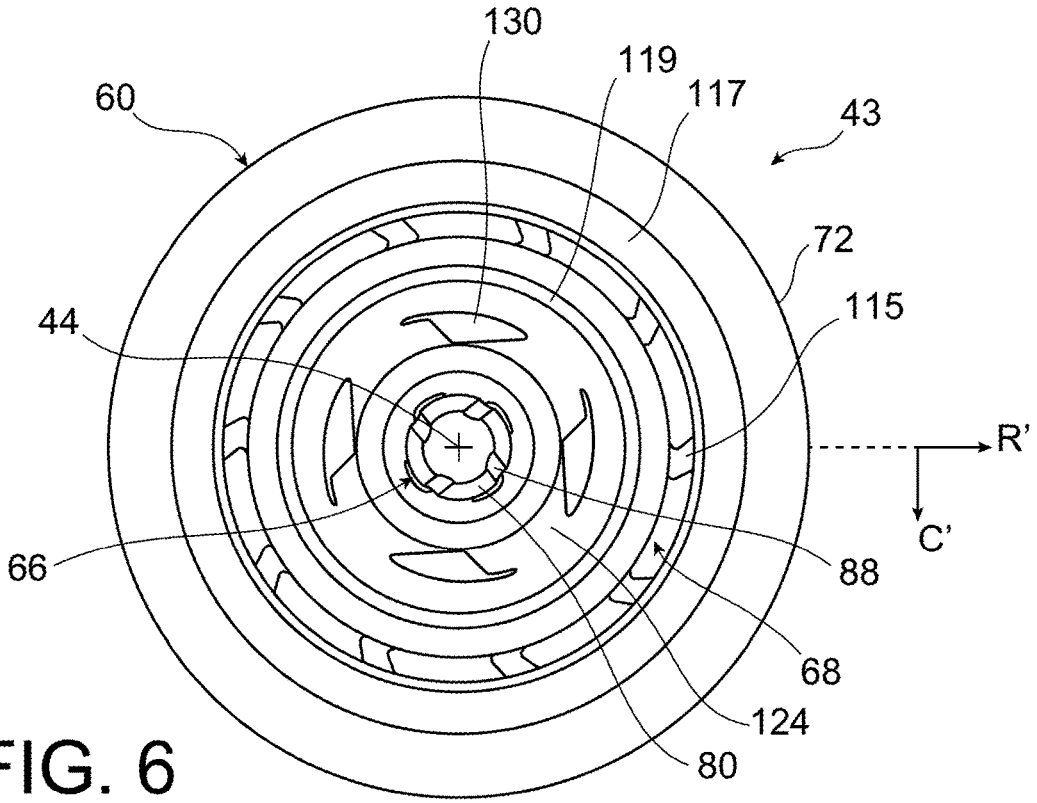
FIG. 6 is a schematic view of the injector nose of FIG. 3, seen in front view from the downstream end.
Figure 7:
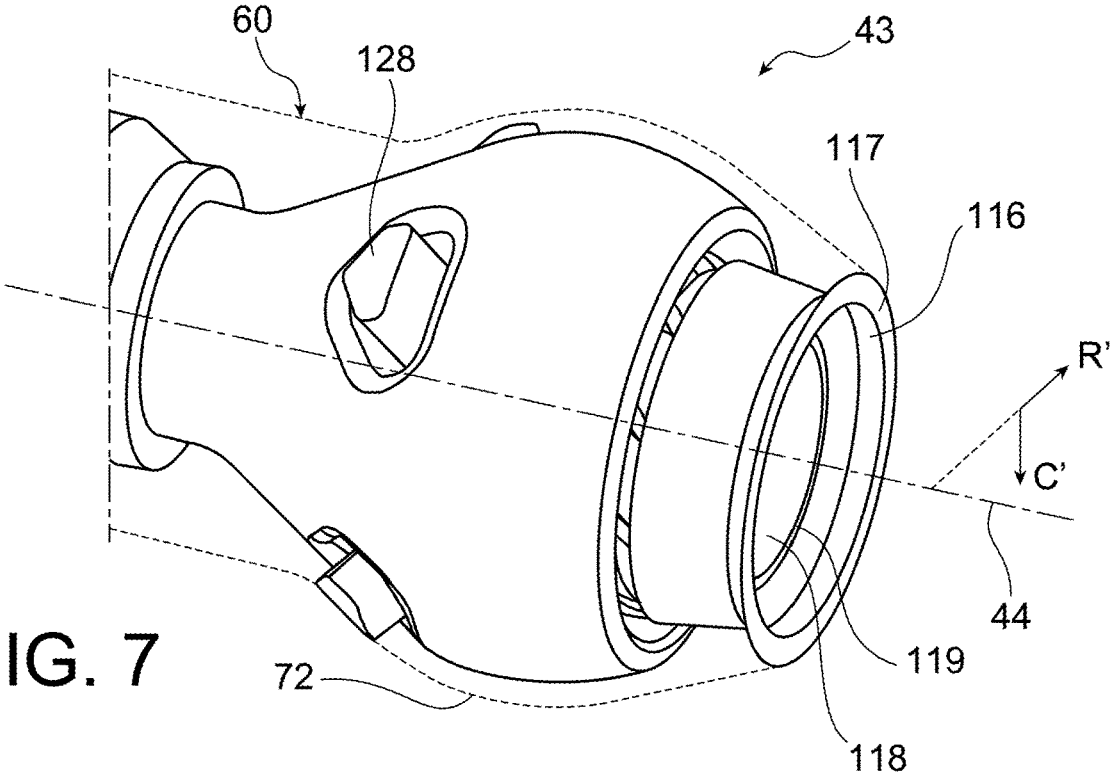
FIG. 7 is a schematic view in perspective of the injector nose of FIG. 3.

The swirler channels 112 have respective downstream ends 115 (FIGS. 4, 6 and 9) emerging in an annular space constituting the terminal ejection part 68 of the secondary circuit 64. As shown by FIGS. 3, 4 and 6, this annular space is delimited externally by an annular external lip 116 of the body 60 having a free end 117, and is delimited internally by an annular internal lip 118 of the body 60 having a free end 119.

As shown by FIG. 4, the secondary tranquilisation chamber 108 and the swirler channels 112 extend around an annular wall 120 that is extended downstream while forming the internal lip 118, and which has an internal radius R1 that is for example greater than an external radius R2 of the cylindrical wall 102 that internally delimits the upstream part of the annular channel 70 of the primary circuit.

The secondary connection channels 104 each form, with the injection axis 44, an angle Ω that preferentially lies between 30 degrees and 60 degrees, and which is for example equal to 45 degrees (FIG. 4).

As is clear in FIG. 8, the secondary connection channels 104 delimit between them, two by two, spaces forming respectively the primary connection channels 76 belonging to the primary circuit 62.

Moreover, as shown more clearly by FIGS. 3 and 8, the secondary fuel swirler 114 is surrounded by the terminal annular chamber 79 that extends the annular chamber 70 of the primary circuit 62.

The injector nose 43 furthermore integrates an air inlet swirler 122 (FIGS. 4, 5 and 8) and an annular air-injection channel 124 cooperating with the terminal ejection part 68 of the secondary circuit 64 to form an aerodynamic secondary injector.

The air inlet swirler 122 is formed by air inlet channels 126, for example four in number, having respective inlets 128 (FIG. 7) opening in the external wall 72 of the body 60, and respective outlets 130 (FIGS. 4-6) emerging in the annular air-injection channel 124, preferentially substantially orthoradially so as to favour the gyration of the air around the injection axis 44.

The air inlet channels 126 extend through the annular channel 70 of the primary circuit 62, between the secondary connection channels 104 (FIG. 8).

The annular air-injection channel 124 is delimited externally by the annular wall 120, and internally by the fuel-ejection nozzle 66, in particular by the terminal connection 92 (FIGS. 3 and 4). The annular air-injection channel 124 is thus arranged radially inside with respect to the terminal fuel-ejection part 68 and is arranged around the fuel-ejection nozzle 66.

As is clear from the above, an upstream part of the primary circuit 62, housed in the injector nose 43, and formed in this case by the annular channel 70 and the terminal annular chamber 79, extends around the secondary circuit 64. This upstream part of the primary circuit 62 is delimited externally by the external wall 72 of the body 60 of the injector nose, so that the upstream part of the primary circuit 62 extends at the periphery of the injector nose.

Because fuel flows in the upstream part of the primary circuit 62 whatever the operating speed of the turbomachine, the upstream part of the primary circuit 62 thus provides the thermal protection and the cooling of the injector nose 43.

In particular, the terminal annular chamber 79 provides the effect of thermal protection and cooling of the injector nose 43 beyond the primary connection channels 76, in the downstream direction, and in particular provides the thermal protection and the cooling of the secondary fuel swirler 114.

Figure 9A:
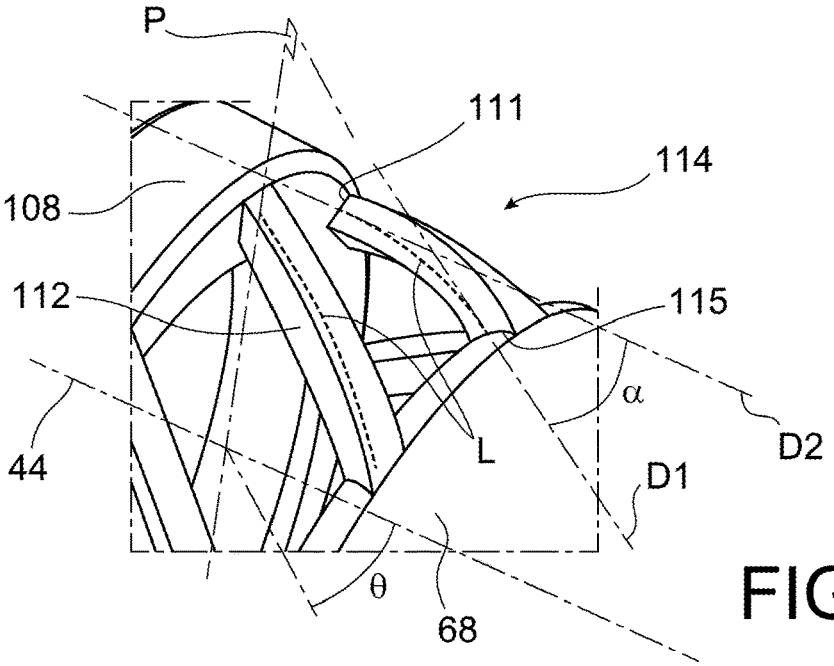
FIG. 9A is a view to a larger scale of a part of FIG. 9.

With reference to FIGS. 9 and 9A, the swirler channels 112 each extend along a respective plane P forming an acute angle θ with the direction D of the injection axis, preferentially lying between 40 degrees and 60 degrees, and for example equal to 50 degrees.

By way of example, each of the swirler channels 112, forming the secondary fuel swirler 114, has a changing cross section of flow, which decreases in the direction going from the upstream end 111 towards the downstream end 115 of the channel. The reduction in cross section of flow between the upstream end and the downstream end of each of the swirler channels 112 is preferably between 10 and 50 percent of the cross section of flow at the upstream end of the channel.

The reduction in the cross section of flow of each of the swirler channels 112 increases the pressure drop between the inlet and the outlet of the secondary fuel swirler 114 and in particular thus accelerates the fuel in the secondary fuel swirler 114, while allowing lower flow rates of fuel at equal pressures at the inlet of the secondary swirler.

The cross section of flow at the inlet of each of the swirler channels 112 is for example 0.2 $mm^2$.

In addition, each of the swirler channels 112 is curved in the corresponding plane P, so that a direction D1 tangent to a midline L of the channel at the downstream end 115 of the latter forms an angle α with a direction D2 tangent to the midline L of the channel at the upstream end 111 of the latter. The angle α is preferentially between 5 degrees and 15 degrees, and is for example equal to 8 degrees. Because of its curvature, each of the swirler channels 112 extends substantially at a constant distance from the injection axis 44, from the upstream end as far as the downstream end of the channel 112.

It should be noted that the body 60 is preferably produced by additive manufacturing. In the example illustrated, this body 60 forms the whole of the injector nose 43 with the exception of the end connection 92. Additive manufacturing techniques are in fact particularly advantageous for producing the body 60 because of the complex geometry thereof.

In operation, fuel flows in the primary circuit 62 and is ejected in the form of a jet at the outlet of the fuel-ejection nozzle 66, whatever the speed of the turbomachine.

At speeds ranging from cruising flight up to takeoff, fuel also flows in the secondary circuit 64. This fuel is set in rotation and accelerated while passing through the swirler channels 112 forming the secondary fuel swirler 114, and forms, at the outlet thereof, a film of turbulent fuel in the terminal ejection part 68 of the secondary circuit 64.

At these operating speeds, the air flow set in rotation by the air inlet swirler 122, and introduced into the annular air-injection channel 124, has a sufficient flow rate to shear the film of fuel at the free end 119 of the internal lip 118 and at the free end 117 of the external lip 116.

What is claimed is:

1. Injector nose for a turbomachine, comprising:

a primary fuel circuit terminating in a fuel-ejection nozzle emerging on an injection axis, and a secondary fuel circuit comprising an annular-shaped terminal fuel-ejection part arranged around the fuel-ejection nozzle, wherein an upstream part of the primary fuel circuit, housed in the injector nose, comprises an annular channel extending around the secondary fuel circuit and delimited by an external wall of the injector nose, wherein the injector nose further comprises air inlet channels extending through the annular channel of the primary fuel circuit and having respective inlets opening in the external wall and respective outlets emerging in an annular air-injection channel arranged radially to the inside with respect to the terminal fuel-ejection part, around the fuel-ejection nozzle, and cooperating with the terminal fuel-ejection part in order to form an aerodynamic secondary injector.

2. Injector nose according to claim 1, wherein the primary fuel circuit comprises primary connection channels connecting the upstream part of the primary fuel circuit to the fuel-ejection nozzle and comprising respective inlets and respective outlets, the respective inlets being arranged radially towards the outside with respect to the respective outlets.

3. Injector nose according to claim 2, wherein the secondary fuel circuit comprises a tubular channel centred on the injection axis and which divides, at a downstream end, into a plurality of secondary connection channels each formed so as to move away from the injection channel in a direction going from upstream to downstream, and each arranged between two consecutive primary connection channels.

4. Injector nose according to claim 3, wherein the annular channel of the upstream part of the primary fuel circuit is arranged around the tubular channel and around the secondary connection channels of the secondary fuel circuit.

5. Injector nose according to claim 1, wherein the secondary fuel circuit comprises a secondary fuel swirler formed by swirler channels having respective upstream ends, and having respective downstream ends emerging in the terminal fuel-ejection part.

6. Injector nose according to claim 5, wherein the secondary fuel circuit comprises an annular-shaped secondary tranquilisation chamber to which the respective upstream ends of the swirler channels forming the secondary fuel swirler are connected.

7. Injector nose according to claim 5, wherein the primary fuel circuit comprises primary connection channels connecting the upstream part of the primary fuel circuit to the fuel-ejection nozzle and comprising respective inlets and respective outlets, the respective inlets being arranged radially towards the outside with respect to the respective outlets, wherein the annular channel of the upstream part of the primary fuel circuit is extended downstream beyond the primary connection channels so as to form a terminal annular chamber surrounding the secondary fuel swirler.

8. Injector nose according to claim 5, wherein each swirler channel has a cross section of flow that decreases in a direction going from the upstream end towards the downstream end of the swirler channel.

9. Injector nose according to claim 1, wherein the terminal fuel-ejection part is delimited externally by an external lip and is delimited internally by an internal lip that separates the terminal fuel-ejection part from the annular air-injection channel.

10. Injection module for a turbomachine, comprising an injection system, and an injector nose according to claim 1, wherein the injection system comprises, from upstream to downstream, a bushing into which the injector nose is mounted, at least one air inlet swirler emerging downstream of the injector nose, and a bowl.

11. Turbomachine, comprising at least one injector nose according to claim 1.

* * * * *